US005754992A

United States Patent [19]

Melnick et al.

[11] Patent Number: 5,754,992

[45] Date of Patent: May 26, 1998

[54] LIFTING FRAME

[76] Inventors: Greg Melnick, 260 7th Street West; Michael Surridge, 664 7th Street East, both of Owen Sound, Ontario, Canada, N4K 3L4

[21] Appl. No.: 450,081

[22] Filed: May 25, 1995

[51] Int. Cl.[6] ..... A61G 7/08

[52] U.S. Cl. ..... 5/81.1; 5/85.1

[58] Field of Search ..... 5/81.1, 83.1, 84.1, 5/86.1, 87.1, 88.1, 89.1, 120; 294/81.1, 81.2, 81.21

[56] References Cited

U.S. PATENT DOCUMENTS

| | | | |
|---|---|---|---|
| 483,753 | 10/1892 | Washburn | 5/120 |
| 662,477 | 11/1900 | Ulrich | 5/85.1 |
| 1,320,799 | 11/1919 | Samuelson | 5/89.1 |
| 1,914,171 | 6/1933 | Scheidegger | 5/84.1 |
| 2,050,269 | 8/1936 | Brooks | 5/84.1 |
| 2,987,340 | 9/1961 | Mattera | 294/81.2 |
| 3,882,555 | 5/1975 | Edlung | 5/81 R |
| 4,112,816 | 9/1978 | Muskus | 5/120 |
| 4,162,550 | 7/1979 | Willingham | 5/120 |
| 4,190,912 | 3/1980 | Nilsson | 5/83 |
| 4,691,394 | 9/1987 | Woo | 5/120 |
| 4,739,526 | 4/1988 | Hollick | 5/83 |
| 4,887,325 | 12/1989 | Tesch | 5/84.1 |
| 4,920,590 | 5/1990 | Welner | 5/86 |
| 5,072,840 | 12/1991 | Asakawa | 212/205 |
| 5,239,713 | 8/1993 | Toivio et al. | 5/84.1 |

*Primary Examiner*—Steven N. Meyers
*Assistant Examiner*—Tuyet-Phuong Pham
*Attorney, Agent, or Firm*—Cushman Darby & Cushman Intellectual Property Group of Pillsbury Madison & Sutro, LLP

[57] ABSTRACT

A frame, sling and hammock is disclosed to be used with a lifting device to support an incapacitated person in an elevated horizontal position as discussed. The device comprises a hanger to connect to a crane, first and second frames cantilevered from the hanger in opposite directions and a net hammock that is looped over the ends of the frames.

3 Claims, 3 Drawing Sheets

LIFTING FRAME

BACKGROUND OF THE INVENTION

This invention relates to a frame and a sling or hammock for a lifting device to temporarily support an incapacitated person in an elevated horizontal position while being transported from one location to another.

Lifting and transportation of incapacitated people (whether living or dead) is a problem frequently experienced in institutions such as hospitals or morgues, particularly where the individual must be moved in a horizontal position. An incapacitated person may be heavy, limp or rigid, sensitive to change in position, or otherwise awkward to lift and carry from place to place. Therefore it is desirable to have some apparatus to assist in handling such persons. Furthermore, a mechanical means of transportation may be safer that manual handling if it reduces the probability that the person might be dropped, twisted or otherwise strained through human error.

In the prior art there have been many devices disclosed for lifting and moving patients. For example, U.S. Pat. No. 4,190,912 discloses a ceiling mounted lifting device having a rigid carrier arm and a transfer means for lateral movement of the arm. The arms are pivotally connected to depending link members which support a sling apparatus that holds a patient in a horizontal position during transport. Other types of lifting devices of different constructions are disclosed in U.S. Pat. Nos. 3,882,555, 4,739,526 and 5,072,840. U.S. Pat. No. 4,920,590 discloses a floor traversing crane with a cantilevered arm from which a hanger 22 may be hung to support a belt device (not shown in the patent).

It will be appreciated by a person skilled in the art that the present invention is adaptable to many lifting devices but a preferred embodiment of this invention has been described in relation to a crane similar in construction to that shown in U.S. Pat. No. 4,920,590.

It is an object of the present invention to provide a frame and a hammock apparatus for carrying a person in a horizontal position using a crane or similar lifting mechanism wherein the apparatus may be disassembled and folded for convenient storage.

GENERAL DESCRIPTION OF THE INVENTION

The present invention provides a hammock and frame combination comprising: a hanger having a crane connection means to connect onto a lifting device and having first and second hanger arms depending downwardly and outwardly from said connection means and ending at a bracket; first and second frames, each said frame having a beam and a plurality of ribs spaced apart along said beam, and each said beam having at one end thereof a slot to connect with a bracket of one of the hanger arms to cantilever the beam outwardly therefrom, and each said rib having rib hook means at each end thereof to permit a hammock to be hung therefrom, and a hammock to underlie and support a person in a prone position having loop means to connect over the rib hooks means to hang the hammock from the frames.

The hanger is a standard feature of certain floor cranes and this invention is intended in part to adapt such floor cranes to transportation of persons in a horizontal position. Certain known hangers are shaped similarly to a common clothes hanger but are constructed in materials and shapes to support heavy loads and have upward curving hooks at an end of each of two downward and outward extending hanger arms. (The term "outwardly" means away from the crane connection means in a plane containing the hanger arms). Each beam of this invention has a slot that receives an upwardly curving end of one of the hanger arms when the slot is angled upwards and outwards from the end and connects with the end as the beam is angled downwards to a horizontal position.

The beams are constructed from materials and in structural forms suitable to withstanding anticipated forces. Each of the beams may be further supported at its ends or along its length by a tensile member running from a position on the crane or hanger and having depending tensile members connected to the beam along its length to form a suspension truss. In a preferred embodiment described hereafter the tensile member is a wire running from the crane connection to the ends of the beam members.

The ribs of each beam are pivotally connected to permit them to be rotated to a position parallel to the beam for storage in a more compact form. In a preferred embodiment described hereafter the ribs at fastened along the beam with their fulcrums at different lateral positions so that the ribs may be rotated over the beam and lie parallel to one another.

DESCRIPTION OF THE FIGURES

In the figures which illustrate a preferred embodiment of this invention.

DESCRIPTION OF PREFERRED EMBODIMENT

In the Figures like elements are assigned like numerals.

Figure 1:
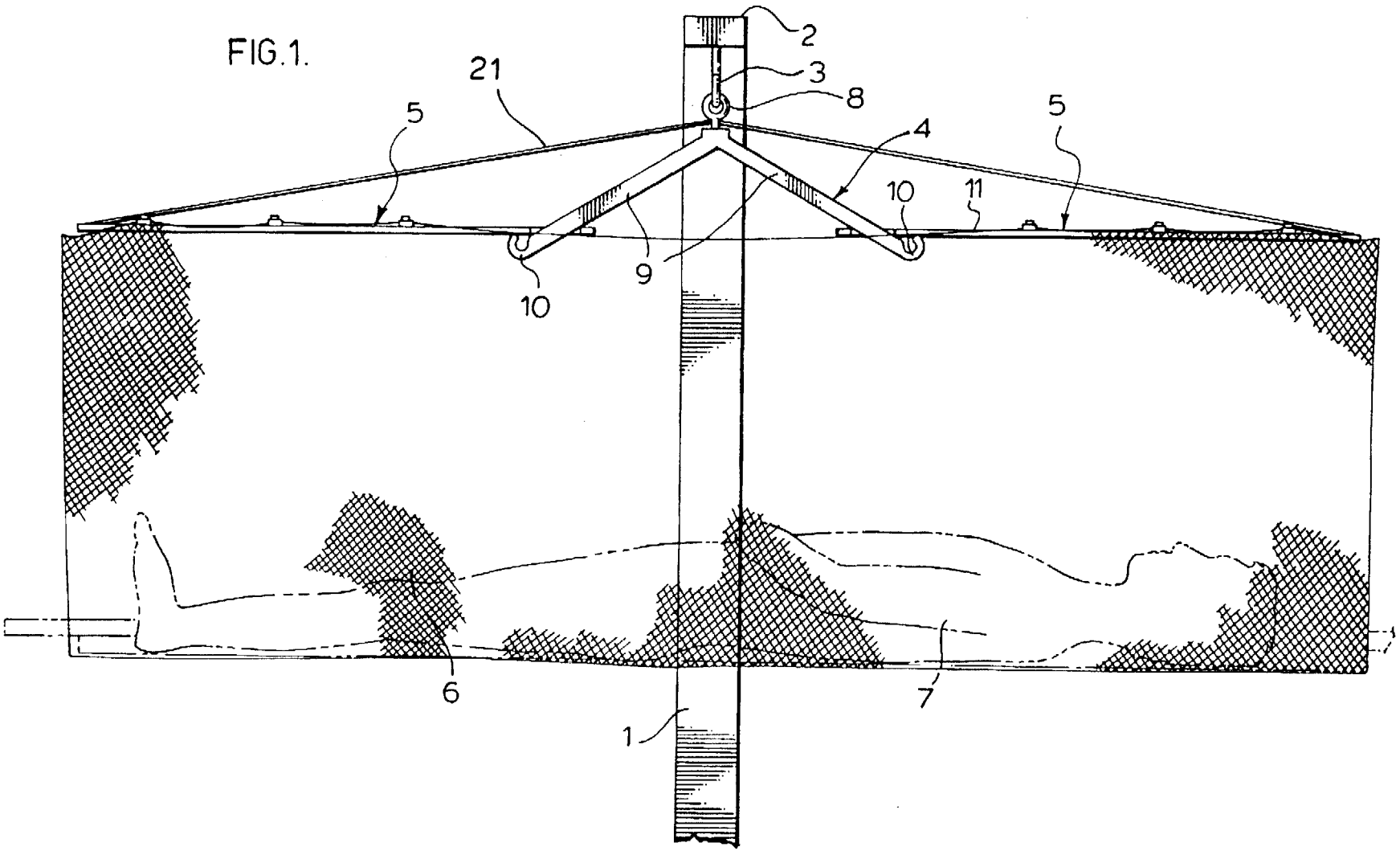
FIG. 1 is a side view showing a person lying in an elevated horizontal position.

FIG. 1 illustrates the invention in combination with a floor crane. The construction of the crane is not part of this invention and is not shown in detail but it may be similar to that shown in U.S. Pat. No. 4,920,590. A crane column (1) supports a crane arm (2) from which depends a connecting means, such as hook (3). A hanger (4) is hung on hook (3) and carries two frames (5) which in turn support a hammock (6) to carry a person (7) lying in a horizontal position. The hanger (4) may be hung on the hook (3) by means of any conventional connecting means, such as eyelet (8).

The hanger (4) has two arms (9) which depend downwardly and outwardly, each terminating in a upwardly curving end (10).

Figure 2:
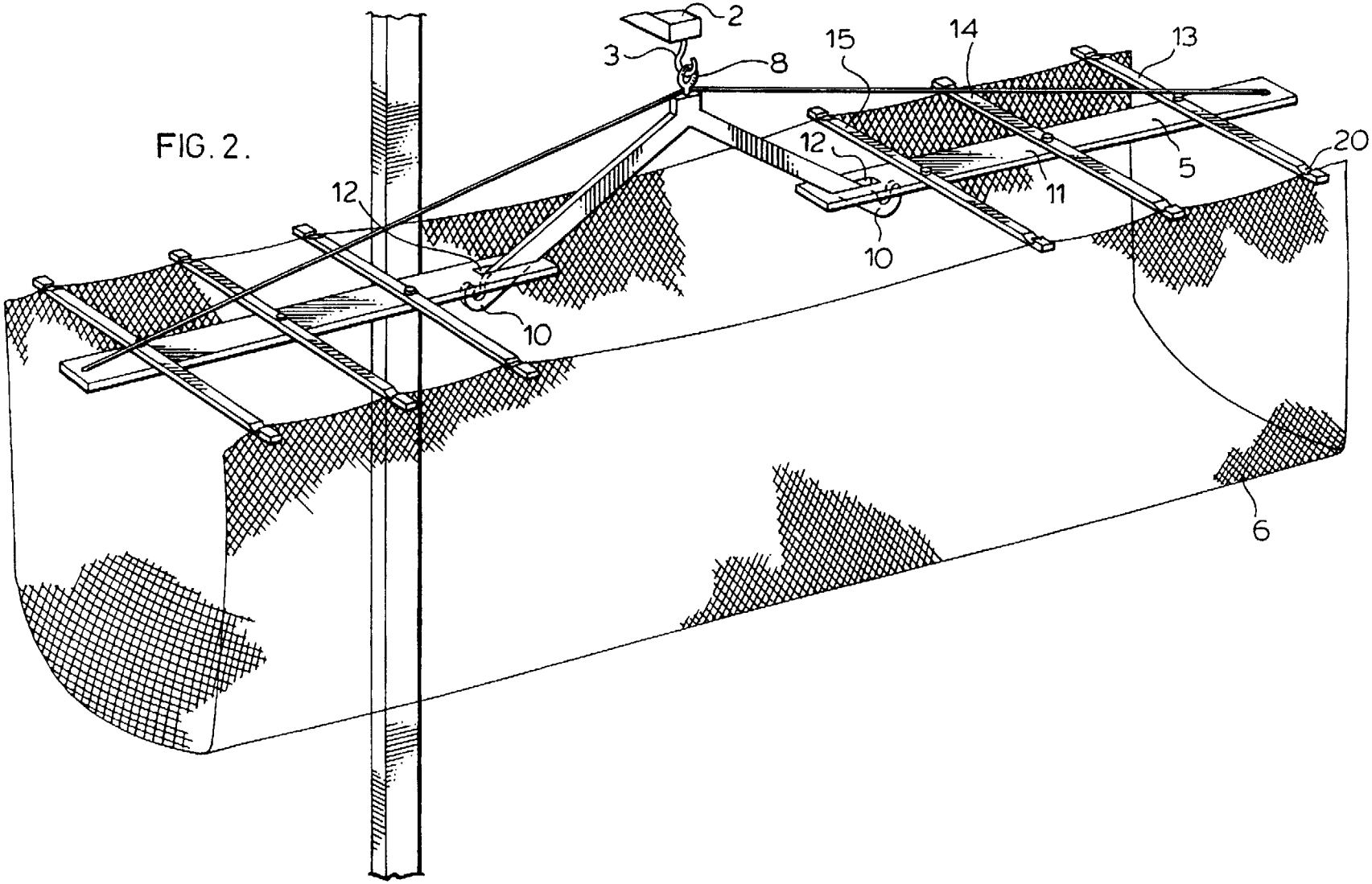
FIG. 2 is an overhead prospective view.

The frames are connected to the hanger as shown in FIG. 2. Each of the frames (5) has a beam (11) with a slot (12) sized large enough to permit the slot (12) to fit over a hanger end (10) but small enough to permit the slot (12) to jam against the inside edge of the hanger arm (9) and the top of the end (10) when the frame (5) is cantilevered horizontally out from the hanger (4). It certain embodiments there may be two slots (12) provided in the beam (11) one which receives the hanger bracket hook (10) and another which catches the end (10) from the underside of the beam (11) to secure the connection. It will be appreciated that other means of connecting the cantilevered frames in within the art and no particular means is essential to this invention.

Figure 3:
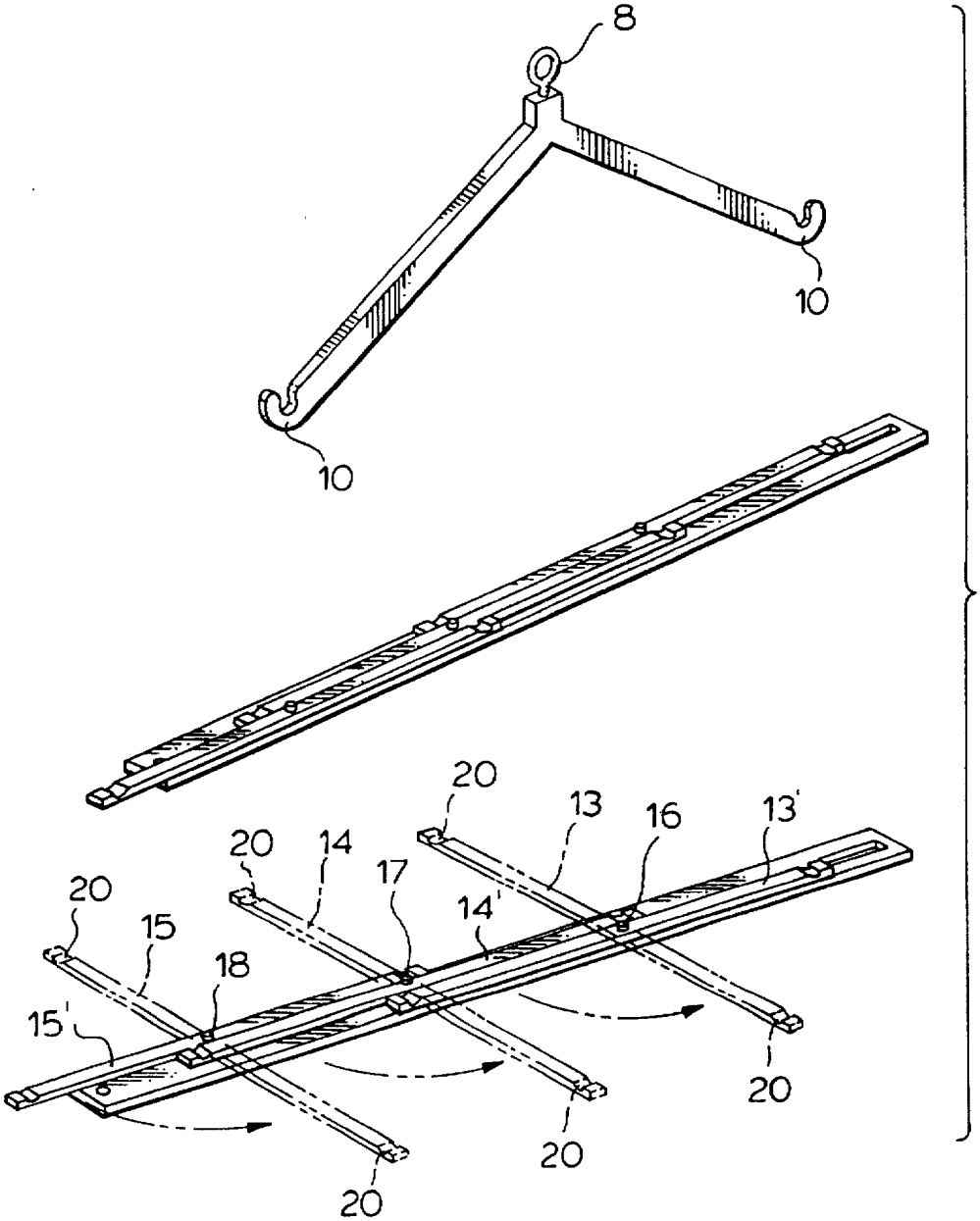
FIG. 3 is a detail of the support frame in folded and unfolded positions.

As shown in FIGS. 2 and 3, the frames (5) each comprise a plurality of ribs, such as (13), (14) and (15) rotatably mounted on a beam (11). Pivot lugs (16, 17 and 18) of the ribs (13, 14 and 15 respectively) are offset from each other longitudinally to permit the ribs (13, 14 and 15) to be rotated in a horizontal plane and laid in parallel alignment over the beam (11). The ribs in the folded position are shown in FIG. 3 as 13', 14' and 15' respectively.

A net (6) may be hung from the outer ends of ribs (14, 15 and 16) to carry a person (7). As shown in FIG. 3 the ends of the ribs may be shaped as grooves (20) to receive a loop to hang the net.

A suspension truss may be formed to provide additional support for the cantilevered beams (11). A tensile member, such as a wire (21), may be inserted through the ends of beams (11) and about the hanger eyelet (8). It will be appreciated that additional tensile support members may be added as needed along the length of the beam (11) where heavy loads are anticipated.

In operation, the net (6) of this invention may be slipped under a person (7). The hanger (4) may be hung from crane hook (3) and the slots (12) of the beams (11) fitted onto the ends (10) of the hanger arms (9) and connected thereto. The ribs (13, 14 and 15) may be rotated at right angles to each beam (11) and a wire (21) may be connected through the ends of the beams (11) and about the eyelet (8). The frames (5), thus constructed, may be positioned with the crane above the person (7) lying on the net (6) and the net (6) may be connected into the grooves (20) formed in the ends of the ribs (13, 14 and 15). The crane then elevates the hanger, frame and net assembly to carry the person in a prone position to another location.

The construction of the frames (5), the slot connection to the hanger (4) and the net (6) facilitate assembly and disassembly. The ability of the ribs to fold over the beam (11) and lie parallel to each other permits convenient storage of the frame when it is not in use.

What is claimed is:

1. A hammock and frame combination comprising:

a hanger having a crane connection means to connect to a lifting device and having first and second hanger arms depending downwardly and outwardly from said connection means to upwardly curving ends;

first and second frames, each said frame having a beam and a plurality of transverse ribs spaced apart along said beam, each said beam having an inner end, an outer end, a slot near the inner end to connect with an end of a hanger arm to cantilever the beam outwardly, and a hammock having rib connection means to connect the rib end to hang the hammock to support a person, wherein the ribs are pivotally connected to the beams at fulcrums longitudinally offset to permit the ribs of each beam to be rotated to lie in parallel juxtaposition on the beam for storage.

2. The combination of claim 1 having one or more tensile members depending from the crane connection means to each of the beams to form a suspension truss to support said beams.

3. A hammock and frame combination comprising:

a hanger having a crane connection means to connect to a lifting device and having first and second hanger arms depending downwardly and outwardly from said connection means to upwardly curving ends;

first and second frames, each said frame having a beam and a plurality of transverse ribs spaced apart along said beam and a supporting suspension truss, each said beam having an inner end, an outer end, a slot near the inner end to connect with an end of a hanger arm to cantilever the beam outwardly, each said rib being pivotally connected to the beams at fulcrums longitudinally offset to permit the ribs of each beam to be rotated from the transverse position to lie in parallel juxtaposition on the beam for storage and each said rib having a grooves at opposite ends thereof to receive a net loop, each said suspension truss having one or more tensile members depending from the crane connection means to each of the beams to support said beams;

a hammock comprising a net having loops to connect over the grooves of the rib ends to hang the hammock to support a person.

* * * * *